US006353949B1

(12) United States Patent
Falbo

(10) Patent No.: US 6,353,949 B1
(45) Date of Patent: Mar. 12, 2002

(54) TILT TABLE FOR DISEASE DIAGNOSIS

(76) Inventor: Michael G. Falbo, 3209 NE. 69$^{th}$ St., Gladstone, MO (US) 64119

( * ) Notice: Subject to any disclaimer, the term of this patent is extended or adjusted under 35 U.S.C. 154(b) by 0 days.

(21) Appl. No.: 09/498,424

(22) Filed: Feb. 4, 2000

(51) Int. Cl.$^{7}$ ..... A61G 7/005
(52) U.S. Cl. ..... 5/610; 5/624
(58) Field of Search ..... 5/610, 611, 624

(56) References Cited

U.S. PATENT DOCUMENTS 3,997,926 A * 12/1976 England ..... 5/610
4,761,000 A * 8/1988 Fisher et al. ..... 269/323
4,769,584 A * 9/1988 Irigoyen et al. ..... 318/648
5,131,105 A * 7/1992 Harrawood et al. ..... 5/611
5,205,004 A * 4/1993 Hayes et al. ..... 5/611

* cited by examiner

*Primary Examiner*—Michael F. Trettel
(74) *Attorney, Agent, or Firm*—Spencer Fane Britt & Browne LLP

(57) ABSTRACT

A device and method for positioning a patient at various angles of incline and decline is provided which permits patient positioning at accurate, reproducible angles of incline and decline and which allows variable speed raising and lowering of the patient and emergency lowering of the patient while permitting repositioning of the device while accounting for variations in the table mounting surface in achieving accurate and reproducible angles of incline and decline.

30 Claims, 8 Drawing Sheets

TILT TABLE FOR DISEASE DIAGNOSIS

FIELD OF THE INVENTION

The present invention is in the field of patient examination tables. In general, the present invention is directed to a patient examination table capable of providing an angle of incline or decline about a horizontal axis for use in conducting disease diagnosis. In particular, the present invention provides a mobile examination tilt table capable of automatically providing accurate and reproducible angles of incline and decline, also known as Reverse Trendelenburg and Trendelenburg positions, for analysis of patient disease states such as syncope.

BACKGROUND OF THE INVENTION

In various diagnostic procedures it is critical to be able to position the patient at various angles of incline and decline in order to assess various disease processes. In one such disease process, syncope, a patient will spontaneously faint due to difficulties in sustaining proper blood supply to the brain. To observe cardiac status at the time of fainting, it is necessary to place the patient in a nearly vertical position which will allow the fainting behavior to occur. In order to attempt to diagnose unexplained fainting, the patient is placed in a supine position on a tilt table, and the patient is inclined to a nearly upright position. This position is usually between 60° degrees and 85° degrees head-up from the horizontal. When the fainting episode occurs, it is vital to immediately and rapidly lower the patient into a horizontal or head-down position, or a Trendelenburg position in order to restore blood flow to the patient's head and restore consciousness.

In carrying out this type of assessment of the patient's condition, it is important to be able to position, and reposition, accurately the patient at various degrees of incline so syncopal episodes can be reproduced and observed repeatedly. It is equally important that the same patient be reproducibly positioned over time into the same position of incline to allow reassessment of the syncope episodes.

In general the prior art devices for conducting such tilt-table studies are fixed-in-place tables which require the user to determine the angle of incline or decline by using a mechanical indicator such as observing the bubble position in a bubble gauge inclinometer that is attached to the side of the movable table surface. This type of device relies upon the user to accurately observe the position of the angle and to be able to repeatably reproduce the angle. This presents a problem of incline accuracy and incline reproducibility when different operators are used and a span of time intervenes between two test periods. The present invention avoids these drawbacks of the prior art while providing additional "one-button" control of the tilt table movement to eliminate further the inaccuracy and irreproducibility which is presented by mechanical indicators such as bubble gauge inclinometers, the variation between different table operators and the variation of time intervening between test sessions.

The present invention provides accurate tilt or angle positioning of a patient and allows accurate reproduction of the selected angle of incline while permitting rapid repositioning of examination surface or assembly 12 into a Trendelenburg position of approximately negative 15° or fifteen degrees below horizontal. The inventive combination further permits tilting a patient selectably at a fast or slow speed while automatically providing a ramping down of the motor speed as the patient approaches the desired angle.

SUMMARY OF THE INVENTION

A principal object of the present invention is to provide a tilt table for disease diagnosis having user selectable, accurate, and reproducible, automatic incline and decline positioning and repositioning of a patient. The table can also be mobile, in which case it provides accurate and reproducible repositioning from one diagnostic test to the next and from a first patient visit to a second patient visit and from a first table location to a second table location.

Another object of the present invention is to provide a portable tilt table having accurate and reproducible inclining and declining of a patient, using a variety of alternative methods, while accounting for the degree of slope present in the floor on which the invention is situated.

It is another object of the present invention to provide a portable tilt table which provides accurate and reproducible inclining and declining of a patient from visit to visit utilizing a number of equivalent devices even though the invention has been moved from one location to another between the patient visits.

Still another object of the present invention is to provide user selectable multiple speeds of movement of the tilt table between various angle of tilt positions.

Another object of the present invention is to recognize the remaining distance between a designed angle of incline and the present position of the tilt table to allow a reduction in the velocity of table movement to avoid sudden stopping of the table at the desired position and to avoid bumping and jerking movements of the patient during table incline and decline movement operations.

Yet another object of the tilt table of the present invention is to provide user programmable standard positions of incline and decline for use during patient disease diagnosis.

Yet another object of the present invention is to provide a device and method of accurately and precisely moving from a first table incline or decline position to a second position in a reproducible manner.

Another object of the present invention is to provide user selectable one-button emergency repositioning of a patient from an incline position to a decline position.

Still another object of the present invention is to provide user selectable one-button repositioning of a patient from an incline or decline position to a level of zero degree of incline or decline position.

Another object of the present invention is to provide user accurate and reproducible patient incline and decline positions by determining the table angle using an inclinometer communicating with a central processor to determine the table position of incline or decline.

Another object of the present invention is to provide the user the opportunity to preselect the position to which the bed will reposition when an emergency reposition button is selected by the operator.

Another object of the present invention is to provide user accurate and reproducible patient incline and decline positions by determining the amount of table movement toward an incline or decline angle using counter mechanism on the table tilt drive, the counter mechanism being in communication with a central processor to determine the table position along the path of incline or decline path of travel.

The foregoing and other objects are not meant in a limiting sense, and will be readily evident upon a study of the following specification and accompanying drawings comprising a part thereof. It is to be understood that all the above objects need not be present in every embodiment of the invention, rather various objects can be presented and satisfied in different embodiments. Other objects and advantages of this invention will become apparent from the following description taken in connection with the accompanying drawings, wherein is set forth by way of illustration and example, an embodiment of this invention.

These objects and more are provided by the present invention which comprises a table examination surface which is repositionable to various angles of incline or decline by use of a central processing unit (CPU) to determine when a selected angle of tilt is achieved. Repositioning of the examination surface can operate at various speeds by use of a variable speed motor to reposition the examination surface to any angle of incline or decline which is desired by the user. This is generally accomplished by method of the user selecting the desired examination surface angle of incline or decline and activating the variable speed drive. The variable speed drive is controlled by a computer processor which is in communication with a means for determining the position of the examination surface or examination assembly along a path of travel. When the exam surface approaches the desired angle of incline or decline the computer processor instructs the variable speed drive to reduce its velocity of movement of the examination surface to avoid sudden or jerky movement of the examination surface as it approaches the desired angle of incline or decline and to provide the patient with a more tolerable or comfortable cessation of travel.

The means for determining the position of the examination surface comprises an electronic form of inclinometer in one embodiment which provides a processor with a signal for use in positioning and repositioning the examination surface or table assembly of the tilt table. In another embodiment a shaft encoder on the the variable speed drive provides the means for determining the position of the examination surface. In yet another embodiment a combination of the inclinometer and the shaft encoder are used to position and reposition the examination surface or assembly of the tilt table.

DESCRIPTION OF THE DRAWINGS

Preferred embodiments of the invention, illustrative of the best modes in which the applicant presently contemplates applying the inventive principles, are set forth in the following description and are shown in the drawings and are particularly and distinctly pointed out and set forth in the appended claims.

DESCRIPTION OF THE PREFERRED EMBODIMENT

Figure 1:
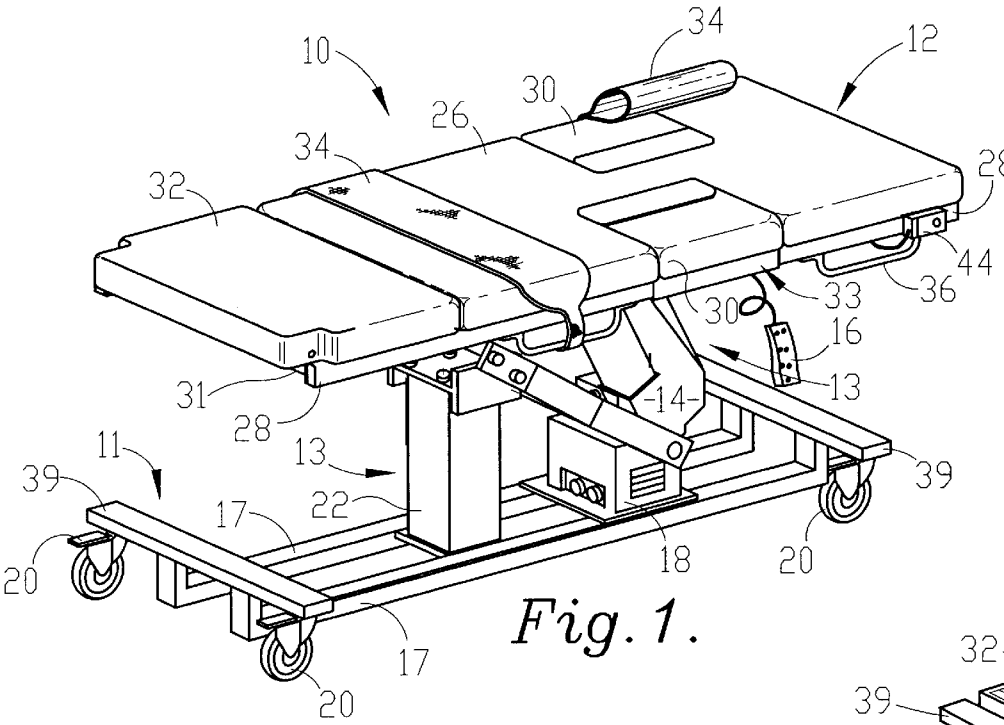
FIG. 1 is a top and side perspective view of the examination table incorporating the inventive tilt mechanism.

Referring now to FIG. 1, tilt table or examination table 10, is shown in a top and side perspective view, the table is comprised of three principal sections: Examination surface or table assembly 12, carriage assembly 11; and movement assembly 13. Carriage assembly 11 comprises breaking castors 20 attached to wheel arm 39 which is supported by cross members 17. Carriage assembly 11 provides examination table 10 with the mobility needed to easily move examination table 10 quickly into any convenient area for patient examination. It will be appreciated, as described hereinafter, that the inventive tilt mechanism of the present invention is particularly suited to a mobile examination table as the inventive tilt assembly allows for correction of uneven surfaces and eliminates the need to permanently mount examination table 10 in order to assure a level surface from which to function. This is but one distinction over the prior art, others will become more clear hereinafter.

Figure 2:
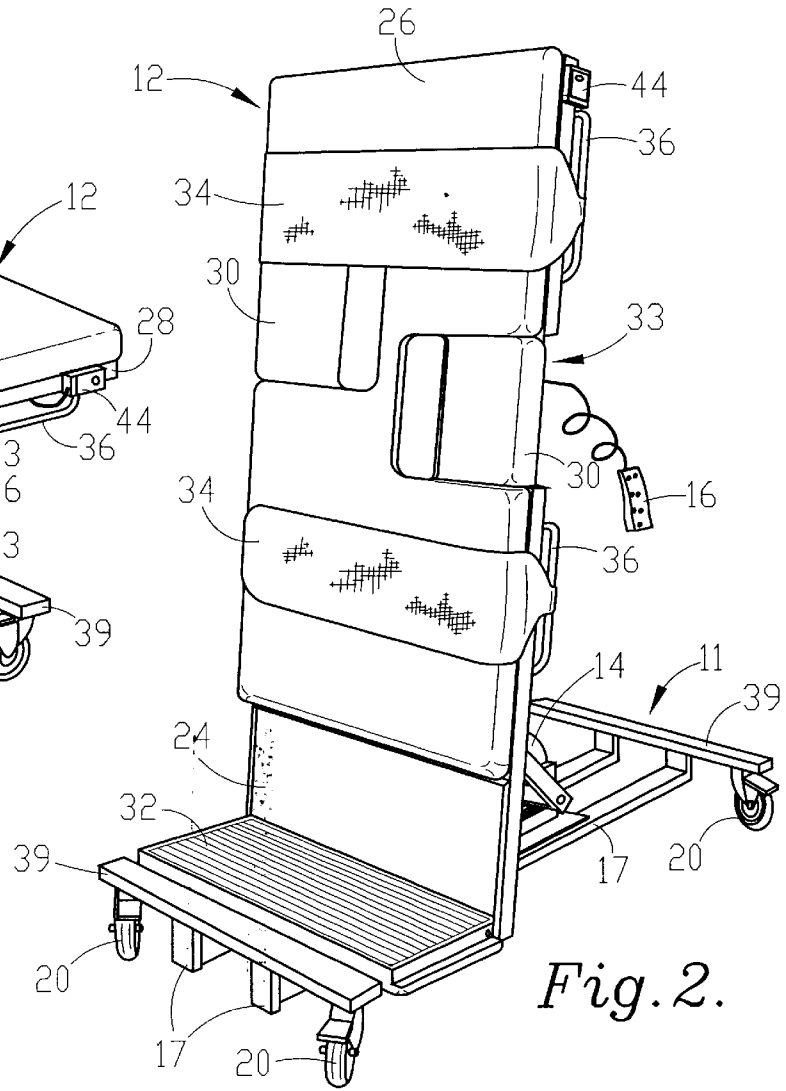
FIG. 2 is an end and side perspective view of the examination table having the table elevated to approximately 85° head-up angle.
Figure 3:
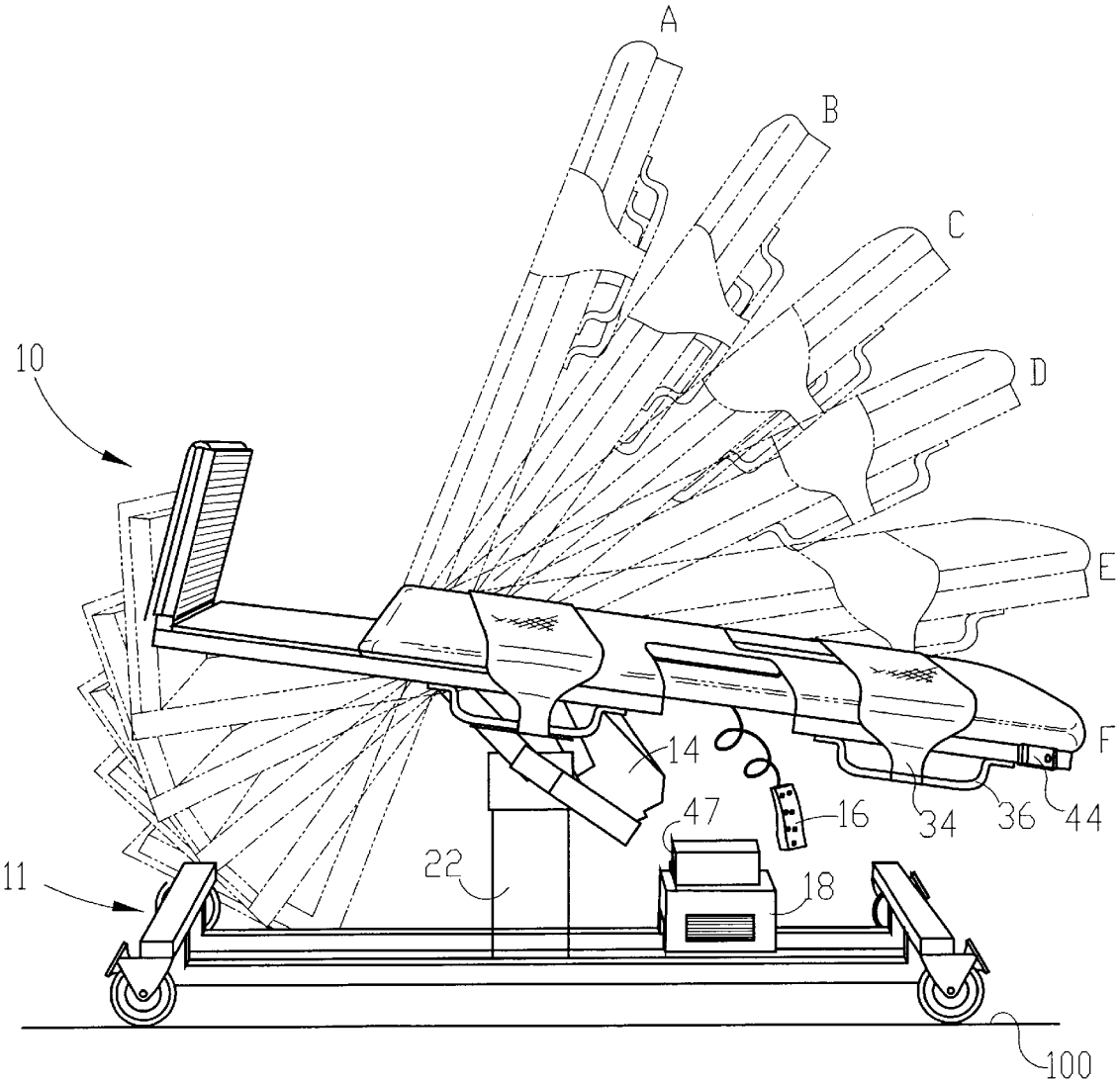
FIG. 3 is a side elevational view of the examination table and showing in phantom lines various incline and decline positions in which the table can be positioned ranging from approximately 85° head-up tilt to min-as 15° head-down tilt.

Once examination table 10 has been moved into position using carriage assembly 11, the table is locked into place using breaking castors 20. The table may then be vertically raised and lowered using elevator pedestal 22 to position examination surface or examination surface or assembly 12 into a proper height for both user and patient. During particular examination procedures, it is beneficial to be able to incline and decline a patient between the horizontal position of examination assembly or surface 12 shown in FIG. 1, and the nearly vertical position of table assembly 12 shown in FIG. 2. In addition, it is beneficial if intermediate positions are available. A variety of such intermediate positions are shown in FIG. 3. It is to be appreciated that throughout this description the terms incline and decline are used to generally refer to angles about a horizontal axis that passes through the examination surface 12 orthogonally to the longitudinal axis of the examination surface 12. Such axis can be appreciated in FIG. 3 as the axis about which examination surface 12 is rotated to provide positions A–F. It is further to be appreciated that when surface 12 is at 0 degrees or a horizontal position that this is considered as being 0 degrees incline or decline.

Examination surface 12 comprises table frame 28 having upper surface 26 attached thereto. Foot plate 32 also is attached to table frame 28, and is connected by hinges 31 to allow foot plate 32 to fold against table frame 28 as shown in FIG. 1, or to allow foot plate 32 to swing to a position 90° from table frame 28 as shown in FIG. 2. Examination surface 12 is equipped with securing belts 34 which are safety devices to hold the patient against examination surface 12 as surface 12 is moved between the horizontal position of FIG. 1 and the nearly vertical position of FIG. 2. For purposes of cardiac disease diagnosis, examination surface 12 may or may not be equipped with one or more access sites 33. Access site 33 is shown having filler section 30 in the closed position. Filler section 30 may be moved between an open and closed position to allow access to the patient chest wall for application of echocardiography equipment to the patient's chest. Further discussion of the utility of access site 33 and filler section 30 for patient examination will be found in U.S. Pat. No. 5,950,262 to Smoler, et al and which is incorporated herein by reference.

Securing belts 34 are attached to examination surface 12 at securing belt brace 36. In use, the patient lies on his back on upper face 26 of examination surface 12 and may or may not be held in place through use of securing belts 34. Alternatively, when it will be desired to raise examination surface 12 into the upright position shown in FIG. 2, foot plate 32 is first placed into the opened position as shown in FIG. 2, and then the patient is allowed to lie on upper surface 26 of examination surface 12 and be held in place by securing belts 34.

The mechanism by which examination surface or examination surface 12 is moved between the positions of FIG. 1 and FIG. 2 as well as the various positions shown in FIG. 3 will be described in detail hereinafter. However, referring now to FIG. 3, it will generally be appreciated that the tilting mechanism of the present invention will allow a great range of tilting motion of examination surface 12 from about 15° below horizontal as shown at position F in FIG. 3, to nearly full vertical positioning as shown at position A in FIG. 3. It is an important attribute of the present invention that examination table 10 can compensate for a floor 100 which is not fully horizontal, that is, very close to 90° from a vertical line. This is accomplished through use of an electronic form of inclinometer which allows examination surface 12 to be independently established at a true horizontal position (90° from gravitational vertical) even though floor 100 on which carriage assembly 11 is resting is not horizontal. This feature is of great significance as it allows the user of examination table 10 to take advantage of the mobility provided by carriage assembly 11 and move examination table 10 into any position or new location without regard to the quality of the floor to be found in that location. This feature allows examination table 10 to be immediately used in a broad spectrum of locations and to be quickly and easily moved from a first location to a second location. This feature is particularly valuable in the hospital situation where space is at a premium. Another advantage of the mobility of examination table 10 is that it permits the inventive table to be easily moved to another location. Examples of this benefit can be seen in the application of a mobile clinic in rural areas, or in a situation in which it is ill-advised to move a patient any great distance to conduct examinations on a tilt table.

A further advantage of the inventive tilt table being operable from a movable carriage is that the need to secure the table to the floor is avoided. This permits a substantial cost savings over prior art tilt diagnostic tables which must be secured to a floor in a room that is dedicated to the tilt table device. The present invention eliminates these drawbacks of the prior art by making tilt table 10 easily mobile while yet maintaining the highest degree of precision in establishing a true horizontal plane, and to allow accurate inclining of the patient at particular angles and reproducibility of those angles of incline even though examination table 10 has been repositioned between the first and subsequent examinations of the same patient. The significance of the inclinometer in achieving this result, as well as equivalent devices described herein which are equivalents or substitutes for the inclinometer will be discussed hereinafter.

Figure 4:
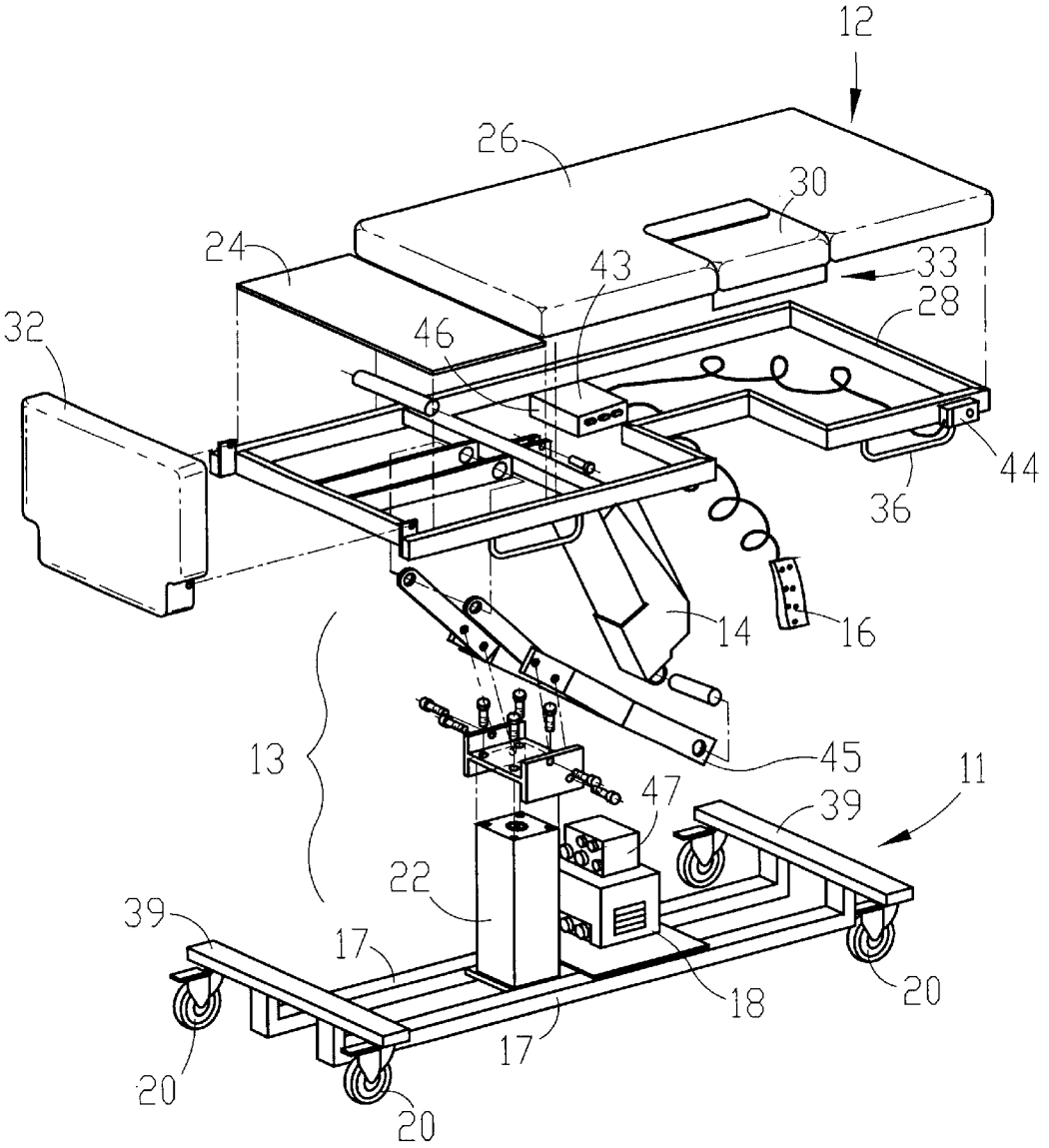
FIG. 4 is an exploded view of the examination table of FIG. 1.

Referring now to FIG. 4, an exploded view of examination table 10 is provided thereby bringing into view additional components of table 10. In FIG. 4, it can be appreciated that foot plate 32 is comprised of frame 42 to which tread 40 and cover 41 are applied. Examination surface or assembly 12 is comprised of padded upper surface 26 which is attached to frame 28, and foot frame 24 which also is attached to frame 28. It will be appreciated that when foot plate 32 is closed against foot frame 24 that the bed appears to be, and is usable as, a standard examination table. In an alternate configuration padded upper surface 26 can be equivalent in size to frame 28 and foot plate 32 could be attached or detached when table 10 is used for tilt procedures. The exploded view of FIG. 4 shows inclinometer 43 and computer processor or central processor unit 46 are secured to the underside of upper surface 26. From this position inclinometer 43 can provide an accurate determination of the particular angle of incline or decline in which examination surface 12 is oriented. Drive 14 is attached to frame 28 and, in one embodiment, is equipped with a shaft encoder to determine the precise amount of rotation in either direction of the shaft of drive 14 as examination surface 12 is reoriented to various degrees of incline or decline. Drive 14 is connected to pivot arm 45 which allows pivotal movement of table frame 28 with respect to pedestal 22 to which pivot arm 45 is fixed. As previously indicated, pedestal 22 allows for up and down vertical movement of examination surface 12. Elevational pedestal 22 and pivot arm 45 and drive 14, as well as their connective hardware, are the components comprising movement assembly 13. Examination surface 12 and movement assembly 13 rests upon carriage assembly 11 which has been previously described.

Still referring to FIG. 4, the components comprising one embodiment for repositioning the angle of tilt for examination table 10 are shown. In this embodiment, these components include the means for determining a position of the examination surface, or inclinometer 43 or its equivalent, which is in communication with the means for analyzing the proximity of a determined position to a selected angle, or central processing unit 46. Computer processor or central processing unit (CPU) 46 is in communication with drive 14 and in communication with pedestal 22 by interconnection therewith through connection box 47. The operator is able to select the commands to be carried out by these components through use of hand wand 16 which is connected to CPU 46. Connection box 47 provides power to elevator pedestal 22. Power transformer 18 provides 220 volts AC to drive 14, and provides various AC and DC voltages for use by inclinometer 43 and CPU 46, and angle selector 44. In one preferred embodiment, these components act in combination to provide the inventive tilt control mechanism.

Still referring to FIG. 4, hand wand 16 allows the operator of tilt table 10 to activate drive 14 and pedestal 22 as desired. Hand wand 16 also allows the operator to select the speed at which table 10 functions. Wand 16 permits the operator to independently move examination surface 12 to any desired elevation or angle of incline or decline as desired and apart from any particular angle which can be selected using angle selector 44. Hand Wand 16 is also equipped with an emergency repositioning button which can be used by the operator to immediately and rapidly reposition the patient on the examination surface 12 into a particular pre-programed position. One useful emergency repositioning is to the horizontal position or 0° incline, another common emergency repositioning is to a head-down position of approximately minus 15° from horizontal or the Trendelenberg position.

Wand 16 can be used to program CPU 46 to either of these positions so that upon the operator pushing a single button, examination surface 12 is immediately repositioned to the 41l preprogrammed position. While this preprogrammed position can be any angle, the horizontal position or the head-down position of approximately minus 15° from horizontal, the Trendelenberg position, is most common. The emergency repositioning buttons also can be programmed to move examination surface 12 to the selected position at a higher-than-normal rate of speed. This is accomplished by adding to the preprogramming the selection of one of the higher speeds of movement provided by the variable speed motor of drive 14.

It will also be appreciated that it is the operator's use of wand 16 that initiates movement of examination surface 12 to the different angles of incline or decline which may be selected at angle selector 44. In general, upon the operator selecting the desired angle to which examination surface is to be repositioned by use of angle selector 44, the operator then depresses the activating button of wand 16 to start examination surface 12 moving toward the selected angle. Upon the conclusion of testing, the operator can select the "home" button on wand 16 to return examination surface 12 to the horizontal position. Wand 16 is also equipped with momentary movement buttons to reposition examination surface 12. These buttons are identified as head up, head down, bed up, and bed down. The head up and head down buttons control tilt and the bed up and bed down buttons control the height of examination surface 12 above the floor by raising and lowering pedestal 22.

Figure 8:
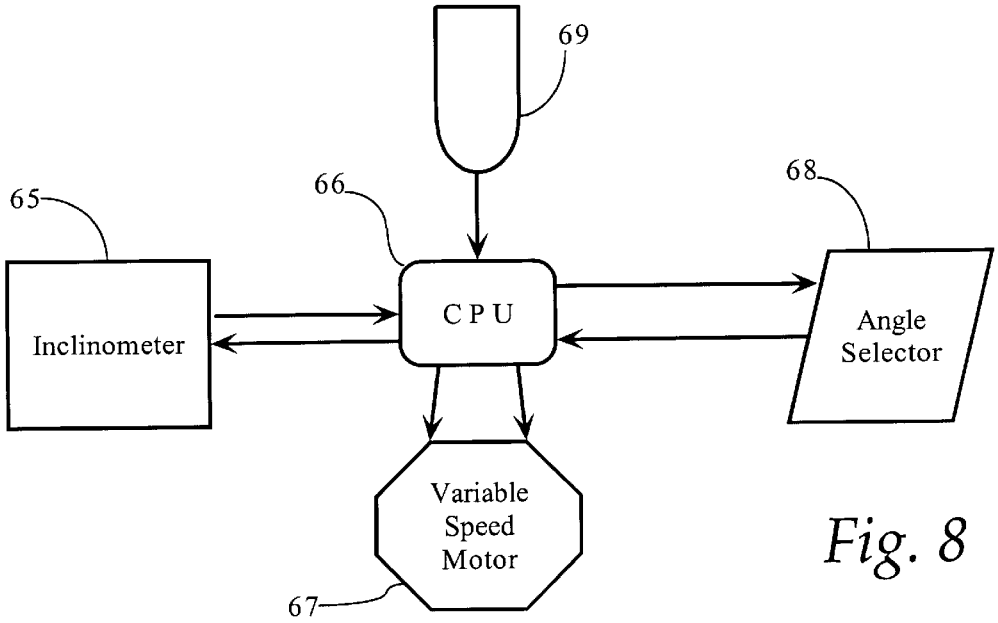
FIG. 8 is a diagram showing the relationship and information flow between the components of the embodiment of the invention control system using an inclinometer.

Referring now to FIG. 8, the components involved in operation of the electronic inclinometer embodiment of the present invention to change the angle of incline of the examination surface 12 and to reproduce angles of incline will be discussed. Computer or central processing unit (CPU) 66 of the invention is in communication with variable speed motor 67, angle selector 68, hand wand (HW) 69 and inclinometer 65. These components operate in combination to achieve the precise positioning and repositioning of the examination table to angles of incline and decline which are selected by the operator.

Inclinometers are long known in the art. Prior art tilt table devices, generally, relied on a mechanical version of the bubble gauge inclinometer. These devices utilize an upwardly or downwardly curved cylinder which is sufficiently filled with fluid to allow only a single bubble to be captured in the cylinder. The bubble gauge is attached to the side of the tilt table. As the table is repositioned to different degrees of incline or decline the position of the bubble is read against a scale of degrees of incline or decline that has been previously calibrated. The user then reads the bubble gauge and stops movement of the table as it approaches the vicinity of a particular angle. This prior art methodology presents a great potential for inaccuracy and error and substantially depends on the operator's accuracy in reading the bubble gauge and the operator's attentiveness in stopping the movement of the tilt table as it approaches the desired angle.

One embodiment of the present invention relies upon an electronic form of inclinometer. This device can take many different physical forms. One such form is a ring-shaped or "donut-shaped" device which is partially filled with a conductive fluid. Two leads,, or conductors, are placed along the interior circumference of the ring on opposite sides, and the ring is fixed to the object for which the angle of incline or decline is desired to be determined. As the object is moved, the ring rotates in response to the change in angle. The resistance across the leads also changes as the fluid shifts in response to the change in angle. A specific voltage will thereby be produced by the inclinometer which can be associated with a particular angle of incline or decline. This specific voltage can be observed and the corresponding angle of incline or decline determined. This use of the inclinometer, in one embodiment of the present invention, provides precise and reproducible angles of incline and decline for automatic movement of the tilt table between various angles of incline or decline.

Those skilled in the art will appreciate that the present invention is not limited to the use of an electronic bubble gauge type of inclinometer or fluid inclinometer, and that many equivalent forms of measuring incline and decline can be substituted as equivalent devices in the present invention. By way of example and not limitation, those skilled in the art will appreciate that a resolver using an electromagnetic-inductive approach or a rotating plate capacitor or a potentiometer or and L C L glass tilt sensor or a magnetometer or and accelerometer or a gyroscope could be substituted as equivalents for the inclinometer or the shaft encoder embodiments which are described with particularity herein.

In the case of the embodiment of the present invention which relies upon the shaft encoder, it will be appreciated that many forms of shaft encoding can be substituted. Optically responsive shaft encoding or magnetically responsive shaft encoding can be utilized.

Still referring to FIG. 8, during operation of tilt table 10 (FIG. 1), CPU 66 receives a particular voltage from inclinometer 65 which corresponds to present actual angle of examination surface or assembly 12 (FIG. 1). This voltage is received by CPU 66 as exam surface or assembly 12 moves through various angles of incline and decline along its path of travel, and when surface or assembly 12 is in a fixed position. The voltage corresponding to the angle of incline or decline detected by inclinometer 65 is transmitted to CPU 66 where the actual voltage detected by inclinometer 65 is compared to a voltage which corresponds to the desired, or selected, angle, or position, which has been entered by the operator through use of angle selector 44 (FIG. 1). As the angle of incline of examination surface 12 changes, the angle detected by inclinometer 65 is compared by CPU 61 to the desired position at angle selector 44 (FIG. 1) entered by the operator, and the CPU determines whether the selected or desired position of examination surface or assembly 12 has been achieved. If the selected position has not been reached, the CPU determines that additional activity of motor 67 is required to achieve the user indicated desired position.

As the angle of incline or decline of exam surface 12 changes and is detected by inclinometer 65, CPU 66 makes additional determinations related to the appropriate motor speed selection. CPU 66 evaluates the proximity of the actual angle of exam surface 12 as detected by inclinometer 65 to the desired position entered by the operator. When the detected angle of incline from inclinometer 65 is within a selected critical proximity to the desired position, CPU 66 will direct motor 67 to switch to a consecutively lower motor speed into using a deceleration curve mode during the final phase of changing exam surface or assembly 12 into the user desired position. The reduction in motor speed is desirable in order to slow the rate of movement by exam surface 12 as surface 12 approaches the desired position. In this manner, examination surface 12 fluidly moves into the final desired position at a rate of angle change which will avoid the patient experiencing a sudden stopping of examination surface 12 at the desired position. This avoids any jerkiness of movement as examination surface 12 achieves the final desired position entered by the operator.

Figure 6:
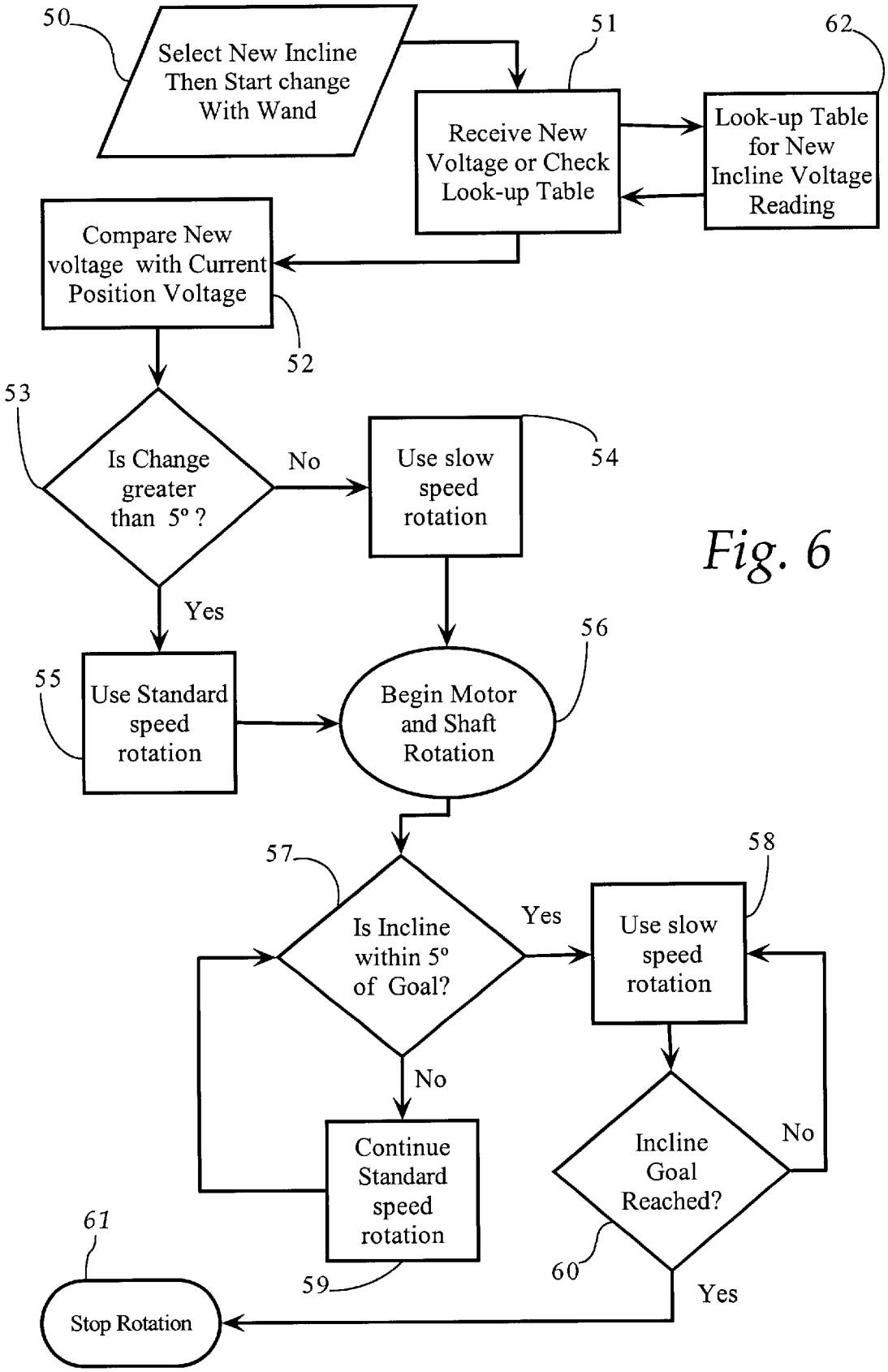
FIG. 6 is a chart showing the operational flow of the invention repositioning mechanism during a command to change the angle of incline without using the emergency or rapid speed.

Referring now to FIG. 6, the interaction between the inclinometer, the computer processor, the variable speed motor and the angle selector previously described will be set forth. The first action taken is that the operator determines that the angle of incline of examination surface 12 needs to be changed. To do this, the operator at decision box 50 enters the desired incline by turning angle selection knob 44 (FIG. 1) to the desired new angle of incline and then depresses the start button on hand wand 16 to initiate the desired change. This angle of incline is either transmitted to the CPU as an actual voltage 51 or, alternatively, the receipt of the new desired incline can cause the CPU to check look-up table 62 for the voltage associated with the new angle of incline. At Box 52, the CPU then compares the received voltage or the look-up table voltage with the current position voltage of examination surface or assembly 12 and determines whether or not a change in position is needed. If it is determined that a change in position is needed, it is determined whether the change from the current position to the new position exceeds a minimum established angle or distance specified by the user. For example, at decision box 53, it is determined by the CPU 66 (FIG. 8) whether or not the change in position is greater than 5°. If the change is greater than 5°, the CPU directs at 55 that a standard speed of rotation command be directed to motor 67 (FIG. 8). If the change is less than 5°, the CPU then directs at 54 that a slow rotation speed or that a deceleration curve of speeds be directed to motor 67 (FIG. 8). Once the motor speed has been determined and communicated to motor 67 (FIG. 8), the motor shaft begins rotation 56. At this point, a feedback loop is initiated in which the voltage reading from the inclinometer is repeatedly compared to the voltage reading for the desired angle. At box 57, a determination is made whether or not the received reading from inclinometer 65 (FIG. 8) is within 5° of the desired incline. If the current incline is not within 5° of the desired incline, a continued standard speed of movement 59 is employed. If the incline comparison at 57 shows that the current position is within 5° of the desired incline, then CPU 66 (FIG. 8) communicates to motor 67 that a slow speed 58 should be utilized. The slow speed 58 is continued until the comparison by CPU 66 (FIG. 8) indicates that the desired incline has been reached at box 60. If the incline has not been reached, slow rotation is continued. Once CPU 66 determines that the desired incline has been reached, then rotation of driver motor 67 (FIG. 8) is stopped 61.

Figure 5:
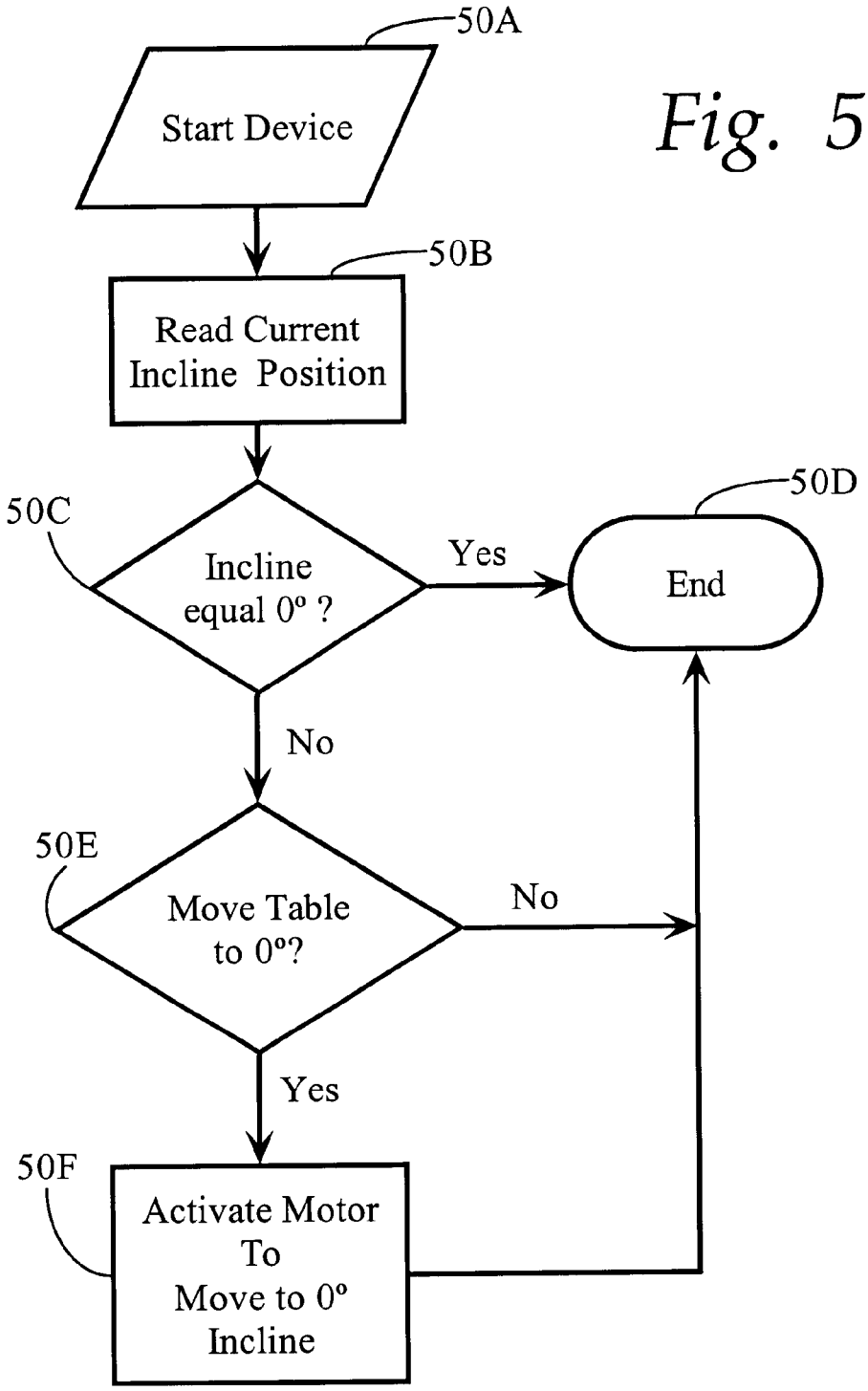
FIG. 5 is a flow-chart showing the optional initialization procedure.

Referring now to FIG. 5, the general flow of information will be discussed which is used to place examination surface 12 at the horizontal position even when carriage assembly 11 (FIG. 1) is on an uneven floor or at an incline or decline. The operator can quickly and easily reposition surface 12 at a level position by pressing a single button on controller 16 (FIG. 1). When the inventive device is started 50A and the "level" is button selected on hand wand 16 (FIG. 2), the current incline position reading 50B is obtained by CPU 66 (FIG. 8) and the current position voltage is compared 50C with the expected voltage reading for a "level" surface 12. If surface 12 is level the process ends 50D. If the detected incline is not equal to the expected voltage the operator can direct 50E that surface 12 be brought to a level position or the operator can choose to keep surface 12 at its current position. If a level surface 12 is desired, CPU 66 directs variable speed motor 67 to move examination surface 12 to a position in which the voltage reading from inclinometer 65 is equal to zero 50 F. This will then provide examination surface or assembly 12 at a position which is level with the horizon and the patient will not have the discomfort of being placed on an incline.

It is an important feature that the angle of incline is reproducible and that it is the same no matter where, or on what surface, the mobile table is located. This is an important distinction of the present invention over the prior art. Most prior art devices are examination tables which are placed in a fixed location and cannot be moved. This limits the utility of the table. If prior art tables are moved from one location to another, the accuracy of incline and decline angles that is achieved by use of fixed distance-of-movement angle controls depends upon whether the new location is level. In the case of a prior art table in which a bubble gauge is observed to bring the table to the new angle the accuracy and precision depends upon the attention of the operator and the reading of the bubble gauge inclinometer. In the present invention, this difficulty is overcome by the use of an inclinometer which is used to establish 0° of incline or decline, or a horizontal position for examination surface 12, through an assessment of a position of 90° from the force of gravity. By making the determination with respect to force of gravity, the surface on which device 10 is mounted is eliminated from any consideration with respect to establishing a completely horizontal surface which is at 0° (90° from vertical) with respect to the horizon.

Figure 7:
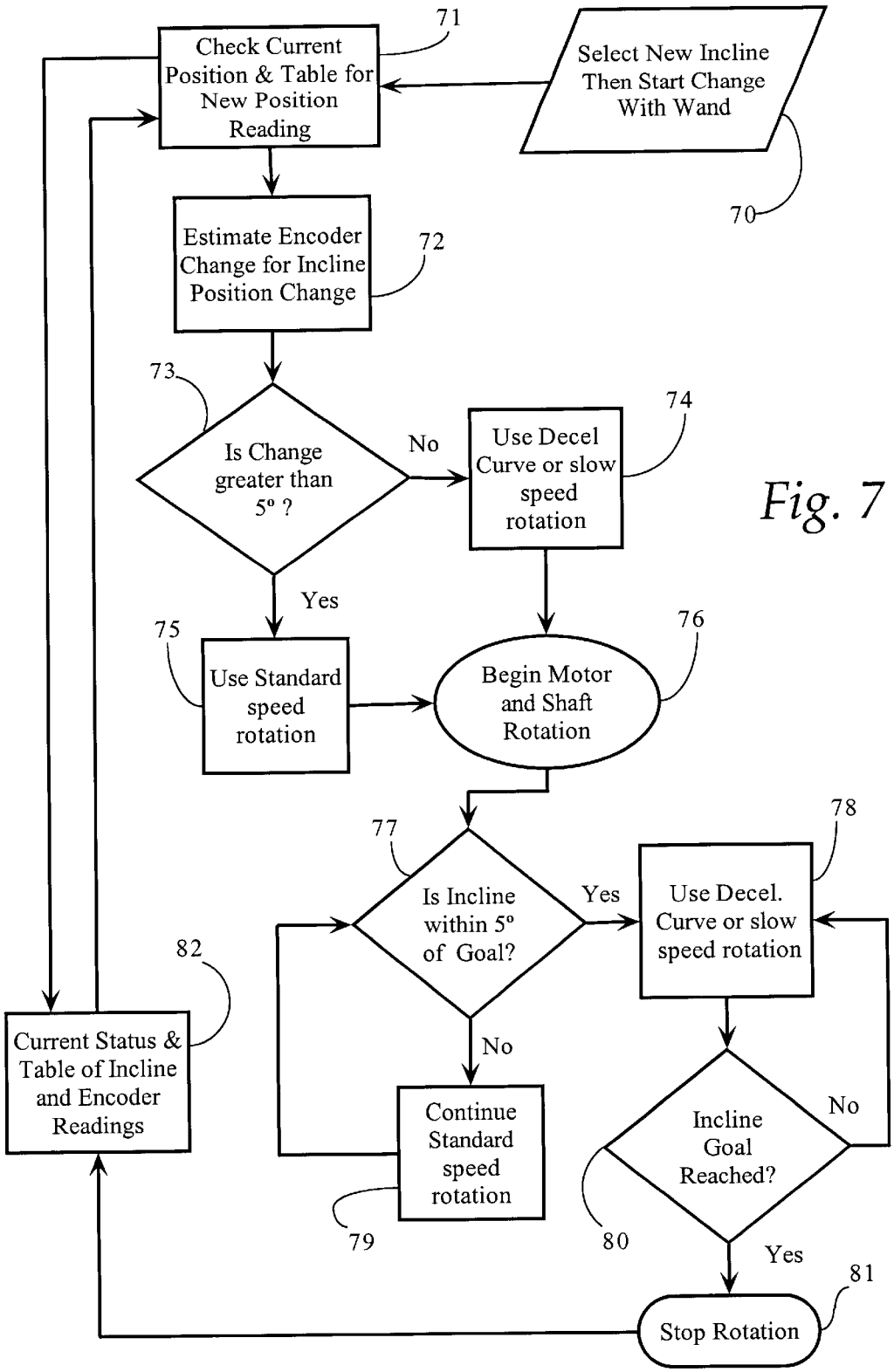
FIG. 7 is the flow diagram showing the operational flow of the inventive control mechanism when a look-up table is used for providing data to the CPU in the embodiment using a shaft encoder.
Figure 9:
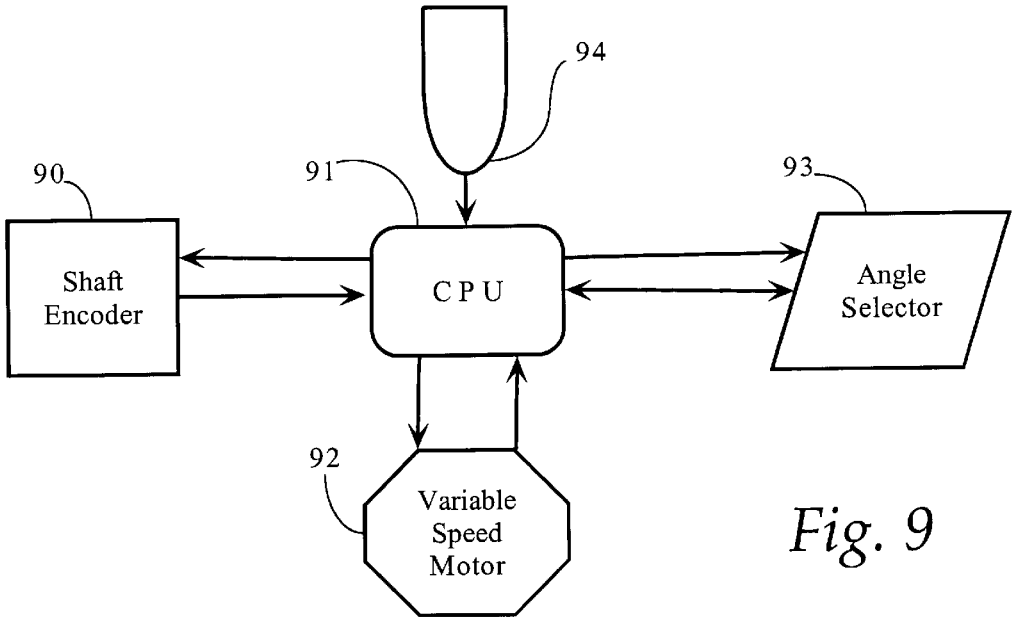
FIG. 9 is a diagram showing the relationship and information flow between the components of the embodiment of the invention control system using a shaft encoder.

Referring now to FIGS. 7 and 9, an embodiment of the present invention will be discussed in which the inclinometer is replaced by a shaft encoder which is in communication with drive 14 to make determinations regarding the position status of examination surface 12. First referring to FIG. 9, the general process of the embodiment utilizing shaft encoder 90 will be discussed. Shaft encoder 90 is capable of measuring the distance which the drive shaft of drive 14 travels during any amount of shaft movement. This measurement by the shaft encoder can be determined from shaft rotational movement or from shaft longitudinal movement. Shaft encoder 90 can make determinations in positive or negative amounts of movement according to the direction the shaft of drive 14 was operating. In one determination method, CPU 91 can recall from memory the current position of examination surface or assembly 12. Alternatively, CPU 91 can use a look-up table associate shaft markings with a particular incline or decline position. CPU 91 can then use a look up table to determine the shaft position for the new or selected angle of incline or decline. CPU 91 then uses these two positions to calculate the amount of movement that variable speed motor 14 (FIG. 1) should provide to establish examination surface 12 at the new angle selected by the operator using angle selector 93. The general result of the shaft encoder method is that the movement of drive 14 (FIG. 1) is measured by the shaft encoder to allow CPU 91 to recognize the location of the shaft in drive 14. This location can be associated with particular angles of incline or decline by use of look-up tables stored in CPU 91. The amount of required movement to the new selected angle is accomplished by CPU 91 calculating the amount of shaft movement required to place examination surface 12 in the new incline or decline. CPU 91 then activates drive 14 to accomplish the change in position. The change in position can be monitored by making repeated readings the shaft encoder output by CPU 91. The CPU through its programming makes comparisons between the current shaft location and the desired shaft location associated with the selected angle of angle selector 93. This is accomplished by CPU 91 utilizing look up tables 82 (FIG. 7) to determine the actual shaft location that is associated with the selected angle that the operator has chosen by angle selector 93.

In operation under the apparatus and method of this embodiment, an operator sets a selected angle using angle selector 93 (44, FIG. 1), the selected angle is communicated to CPU 91. CPU 91 then determines the current position of examination surface or assembly 12 and determines the direction and amount of distance which must be traveled to achieve the new position. These calculations are accomplished through the use of look-up tables which are provided in the memory of CPU 91. Once CPU 91 has made these determinations the movement to the new position is activated by the operator using hand wand 94 (16 in FIG. 1). Once movement begins, CPU 91 monitors shaft encoder 90 and activates variable speed motor 92. As variable speed motor operates, the data from shaft encoder 90 is transmitted to CPU 91 where CPU 91 continuously modifies the current position by adding or subtracting the shaft encoder data from the original current position of examination surface 12. In this manner, the new angle is reached without need of examination surface 12 to first reset itself to a level or zero position in order to move to each new angle selected by an operator.

Referring now to FIG. 7, the general process of operation using the shaft encoder embodiment of the present invention will be discussed. Initially, a command for an incline change 70 is entered by the operator selecting a new angle of incline or decline at angle selector 44 this is followed by the operator initiating the position change by depressing the appropriate button on wand 16. The new angle is communicated to the CPU at Box 71 and the CPU determines the current position for the examination surface or table examination surface 12 using the memory and look-up table at Box 82. The CPU then uses this information and determines the amount of encoder reading change needed to achieve the new incline position. This incline change is then added or subtracted from the current position encoder reading. It also is determined whether or not the change in position is greater than 5° of incline or decline from the current position at decision Box 73. If the change is less than 5°, the CPU will direct variable speed motor 92 (FIG. 9) to utilize a slow rotation speed or a deceleration curve for motor speeds at Box 74. If the change is greater than 5°, the CPU will direct variable speed motor 92 to utilize a standard rotation speed as shown at Box 75. The CPU then directs the variable speed motor to begin rotation at Box 76. Rotation continues while the CPU monitors the situation at Box 77 to determine whether the position of examination surface 12 is within 5° of the goal. If the table has reached approximately 5° of the goal incline, the motor rotation speed is shifted to following a deceleration curve or reduced to a slow rotation speed Box 78 until the incline goal Box 80 is reached. Once the incline goal has been reached, rotation stops, and the current status table of Box 82 is updated with the new incline and encoder reading for the current position of examination surface 12.

Figure 10:
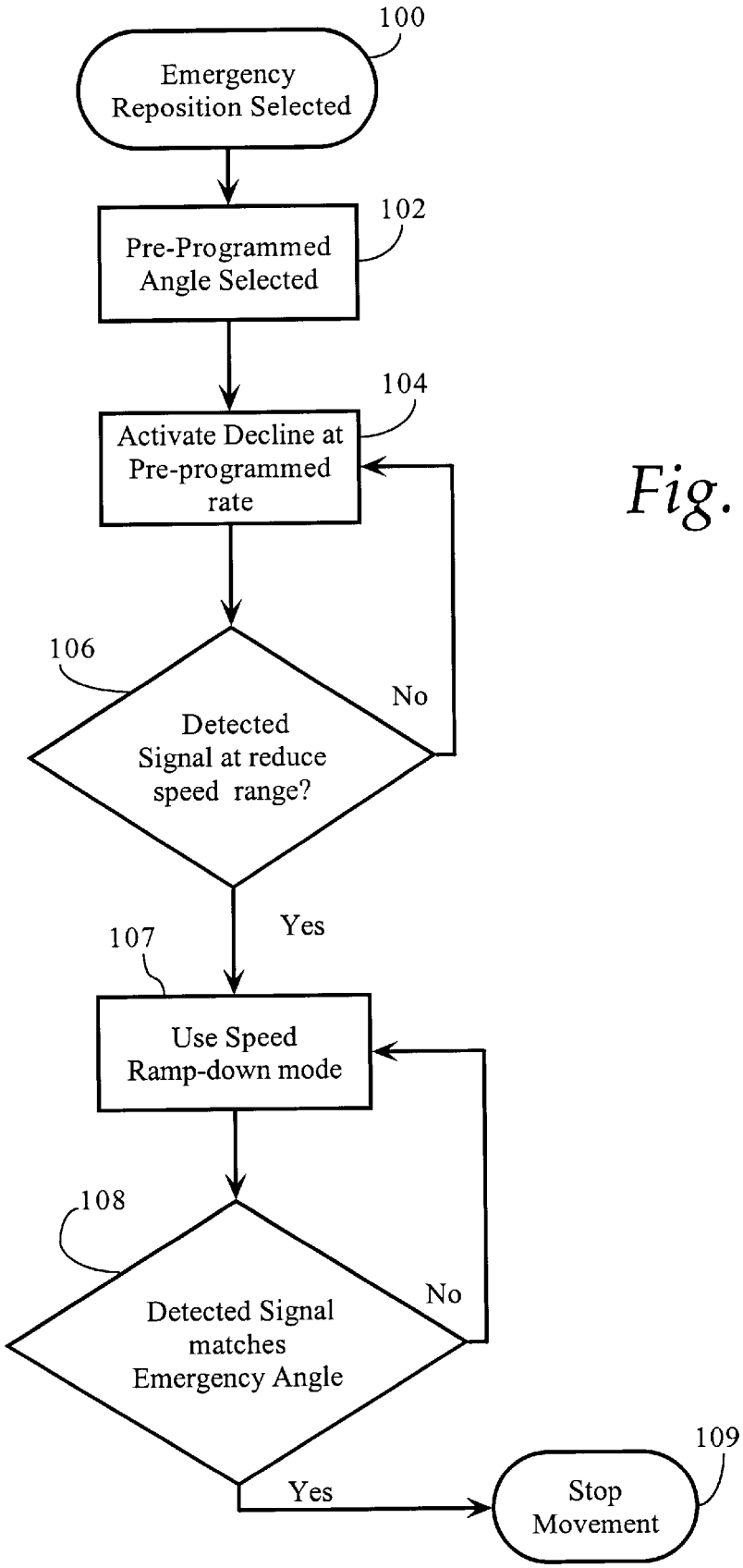
FIG. 10 is the flow diagram showing the operational flow of the inventive control mechanism when an emergency decline command is entered into the system.

Referring now to FIG. 10, the procedure of operation for both the inclinometer embodiment and the shaft encoder embodiment will be described when an emergency situation is detected, and it is necessary to immediately and rapidly lower the patient into a horizontal position or into a head-down position. While an emergency could arise for any reason, it is most often presented when, during the diagnostic procedure, the patient faints, and the physician wishes to lower the patient into a horizontal or a head-down position in order to restore proper blood flow to the head. In this situation, the operator presses an emergency button on hand wand 16 (FIG. 1) as represented by Box 100. This then communicates to the CPU a preprogrammed angle to which examination surface 12 is to be repositioned. This angle can be any angle which is selected by the user and preprogrammed into the device. However, in usual practice, the flat or horizontal position is selected or a head-down position is selected to rapidly restore blood flow to the patient's head. The pre-programmed angle 102 is communicated to the CPU and immediately the CPU directs drive 14 to move examination surface 12 to the pre-programmed position. The CPU activates drive 14 (FIG. 3) at a pre-programmed rate Box 104 which is usually elected to be a faster speed than the standard rate of movement for the examination surface 12. An example of the change in examination surface 12 position is shown in FIG. 3 where examination surface 12 as represented in position A is suddenly and rapidly changed to the position of examination surface 12 shown in position F. In FIG. 3 position F is approximately a 10–15° head-down position which is particularly suitable for reviving a patient after fainting has occurred.

Still referring to FIG. 10, during the course of movement of examination surface 12, the CPU is repeatedly checking the detected signal of the examination surface position to determine whether the detected signal is within the previously described reduced speed range which is encountered as examination surface 12 approaches the selected angle. If the detected signal at Box 106 is not in the reduced speed range, the high rate of speed of Box 104 continues. If the detected signal at Box 106 is within the reduced speed range, the CPU directs in Box 107 that the ramp down speed mode be used. The ramp down speed mode is intended to be a lower speed of movement or the application of a deceleration curve for slowing the rate of movement of examination surface 12 as it approaches the horizontal or head-down pre-programmed position. The CPU continues to check at Box 108 for the pre-programmed emergency angle being achieved. When the angle has not been achieved, the CPU continues the ramp down mode of Box 107. If the pre-programmed emergency angle has been achieved, then the CPU directs movement to stop at Box 109.

In this manner, by use of hand wand 16, the operator can immediately and by simply selecting a single button, immediately and rapidly change the angle of examination surface 12 from an incline angle into a horizontal position or a decline angle as is recommended when the fainting spell occurs. Once examination surface 12 has ceased movement, the operator can then, if the examination surface is so equipped, drop filler 30 to allow placement of diagnostic equipment against the chest wall of the patient.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive tilt table and incline mechanism is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. A diagnostic tilt table is provided comprising:

an examination surface for supporting a patient, drive means to move said examination surface along a path of travel to a selected angle of inclination about a horizontal axis, means for determining a position of said surface along said path of travel to provide a determined position of said surface, and means for analyzing the proximity of said determined position to said selected angle, said means for determining a position electronically communicating data to said analyzing means to allow termination of said drive means operation upon said surface achieving said selected angle.

2. The device as claimed in claim 1 wherein said means for determining a position is an inclinometer.

3. The device as claimed in claim 1 wherein said means for determining a position is a shaft encoder coupled to said drive means.

4. The device as claimed in claim 1 wherein said drive means includes a variable speed electric motor.

5. The device as claimed in claim 1 wherein said means for analyzing the proximity is a computer processor in communication with said means for determining a position.

6. The device as claimed in claim 5 wherein said means for analyzing compares data received from said means for determining a position with data related to said selected angle to allow said processor to analyze the proximity of said determined position to said selected angle.

7. The device as claimed in claim 1 wherein said means for determining a position comprises a shaft encoder coupled to said drive to provide drive position data and means for transmitting shaft encoder drive position data to a computer processor unit in communication with said encoder, said processor determining the starting position of said drive and determining an ending position for said drive based upon said selected angle.

8. The device as claimed in claim 7 wherein said computer processor uses said transmitted encoder shaft position data to determine the proximity of a current position of said drive shaft to said selected angle to determine a drive speed to use by said drive.

9. The device as claimed in claim 1 further comprising carriage means for shifting the table from a first location to a second location.

10. A diagnostic tilt table is provided comprising:

an examination surface for supporting a patient, a variable speed electric motor to move said examination surface along a path of travel to a selected angle of inclination about a horizontal axis, means for determining a position of said examination surface along said path of travel to provide a determined position of said surface, and means for analyzing the proximity of said determined position to said selected angle, said means for determining a position electronically communicating data to said analyzing means to allow termination of said motor operation upon said surface achieving said selected angle.

11. The device as claimed in claim 10 where in said means for analyzing the proximity is a computer processor in communication with said inclinometer.

12. The device as claimed in claim 11 where in said computer processor compares data received from said inclinometer with data related to said selected angle to allow said processor to analyze the proximity of said determined position to said selected angle.

13. The device as claimed in claim 10 further comprising carriage means for shifting the table from a first location to a second location.

14. A diagnostic tilt table is provided comprising:

an examination surface for supporting a patient, a variable speed electric motor to move said examination surface along a path of travel to a selected angle of inclination about a horizontal axis, a shaft encoder coupled to said motor for determining a position of said examination surface along said path of travel to provide a determined position of said surface, and means for analyzing the proximity of said determined position to said selected angle, said shaft encoder electronically communicating said determined position to said analyzing means to allow termination of said motor operation upon said surface achieving said selected angle.

15. The device as claimed in claim 14 where in said means for analyzing the proximity is a computer processor in communication with said shaft encoder.

16. The device as claimed in claim 15 where in said computer processor compares data received from said shaft encoder with data related to said selected angle to allow said processor to analyze the proximity of said determined position to said selected angle.

17. The device as claimed in claim 14 further comprising carriage means for shifting the table from a first location to a second location.

18. A method of positioning and reproducibly repositioning an examination surface for placing a patient at a particular inclination about a horizontal axis for medical diagnostic testing comprising:

selecting a desired angle of inclination about the horizontal axis at which to position the patient, determining an expected inclinometer signal associated with said desired angle, activating a drive to move the examination surface along a path of travel to said desired angle of inclination, comparing the readout from an inclinometer connected to said examination surface with said expected inclinometer signal, and terminating said activating step upon said inclinometer readout being equal to said expected inclinometer signal to position the examination surface at a particular inclination about a horizontal axis for medical diagnostic testing.

19. The method as claimed in claim 18 further comprising the step of analyzing the readout of said inclinometer to determine that point at which said readout is within approximately five degrees of the desired angle.

20. The method as claimed in claim 19 further comprising the step of reducing the speed of said activated drive upon said inclinometer readout being within approximately five degrees of the desired angle to provide a smooth, non-jarring final approach to said desired angle position.

21. A method of emergency repositioning an examination surface for supporting a patient to go from a first inclination about a horizontal axis for medical diagnostic testing to second inclination comprising:

selecting an emergency switch, said switch providing an expected inclinometer signal equal to an inclinometer signal associated with an angle below the horizontal axis, activating a drive to move said examination surface along a path of travel to said desired angle of inclination, comparing the readout from an inclinometer connected to said examination surface with said expected inclinometer signal, and terminating said activating step upon said inclinometer readout being equal to said expected inclinometer signal to provide positioning of the patient at a particular inclination about a horizontal axis for medical diagnostic testing.

22. The method as claimed in claim 21 wherein said step of activating moves said examination surface along said path of travel at a high speed.

23. The method as claimed in claim 21 further comprising the step of analyzing the readout of said inclinometer to determine that point at which said readout is within approximately five degrees of the desired angle.

24. The method as claimed in claim 21 further comprising the step of reducing the speed of said activated drive upon said inclinometer readout being within approximately five degrees of the desired angle to provide a smooth, non-jarring final approach to said desired angle position.

25. A method of positioning and reproducibly repositioning an examination surface for a patient to place the patient at a particular inclination about a horizontal axis for medical diagnostic testing comprising:

selecting a desired angle of inclination about the horizontal axis at which to position the patient, determining an expected shaft encoder reading associated with said desired angle, activating a drive to move said examination surface along a path of travel to said desired angle of inclination, comparing the readout from a shaft encoder attached to said drive with said expected encoder reading, and terminating said activating step upon said shaft encoder readout being equal to said expected shaft encoder reading to accomplish positioning of the patient at a particular inclination about a horizontal axis for medical diagnostic testing.

26. The method as claimed in claim 25 further comprising the step of analyzing the readout of said shaft encoder to determine that point at which said readout is within approximately five degrees of the desired angle.

27. The method as claimed in claim 25 further comprising the step of reducing the speed of said activated drive upon said shaft encoder readout being within approximately five degrees of the desired angle to provide a smooth, non-jarring final approach to said desired angle position.

28. A method of emergency repositioning a patient examination surface to go from a first inclination about a horizontal axis for medical diagnostic testing to a second inclination comprising:

selecting an emergency switch, said switch operating to send an expected shaft encoder reading signal equal to a shaft encoder signal associated with an examination surface inclination useful in emergency situations, activating a drive to move said examination surface along a path of travel toward said examination surface emergency situation inclination, comparing the readout from a shaft encoder connected to said drive with said expected shaft encoder signal, and terminating said activating step upon said shaft encoder readout being equal to said expected shaft encoder signal to provide positioning of the patient examination surface at a particular inclination about a horizontal axis useful in emergency situations.

29. The method as claimed in claim 28 further comprising the step of analyzing the readout of said shaft encoder to determine that point at which said readout is within approximately five degrees of the desired angle.

30. The method as claimed in claim 29 further comprising the step of reducing the speed of said activated drive upon said shaft encoder readout being within approximately five degrees of the desired angle to provide a smooth, non-jarring final approach to said desired angle position.

* * * * *